US006464856B1

(12) United States Patent
Di Tullio

(10) Patent No.: US 6,464,856 B1
(45) Date of Patent: Oct. 15, 2002

(54) SEPARATION OF TARS, OILS AND INORGANIC CONSTITUENTS FROM OIL BEARING SANDS OR SHALES

(75) Inventor: Venanzio Di Tullio, Perth (CA)

(73) Assignee: Deinking/ Solvent Extraction Technologies, Perth Ontario (CA)

( * ) Notice: Subject to any disclaimer, the term of this patent is extended or adjusted under 35 U.S.C. 154(b) by 0 days.

(21) Appl. No.: 09/581,382

(22) PCT Filed: Aug. 31, 1999

(86) PCT No.: PCT/CA99/00784

§ 371 (c)(1),
(2), (4) Date: Aug. 22, 2000

(87) PCT Pub. No.: WO00/22067

PCT Pub. Date: Apr. 20, 2000

(30) Foreign Application Priority Data

Oct. 13, 1998 (CA) ..... 2249110
Jul. 13, 1999 (CA) ..... 2276944

(51) Int. Cl.[7] ..... C10C 1/14; C10C 1/18; C10C 3/08

(52) U.S. Cl. ..... 208/45; 208/39; 208/42; 208/44; 208/309

(58) Field of Search ..... 208/39, 42, 44, 208/45, 309

(56) References Cited

U.S. PATENT DOCUMENTS 4,498,971 A * 2/1985 Angelov et al. ..... 208/309
4,571,269 A * 2/1986 Finch et al. ..... 106/274
6,207,044 B1 * 3/2001 Brimhall ..... 208/14

* cited by examiner

*Primary Examiner*—Thuan Dang
*Assistant Examiner*—Tam M. Nguyen
(74) *Attorney, Agent, or Firm*—Brown & Michaels PC

(57) ABSTRACT

An improved process for the total separation and recovery of four constituents, namely, 1) insoluble pitches and tars also known as asphaltenes, 2) a kerosene based oil fraction, 3) clays and silts of less than 80 $\mu$m mesh and 4) sands of greater than 80 $\mu$m mesh. Recombination of the hydrocarbon fractions is the bitumen portion of tar sands. A further process for the extraction and separation of plant resins from cellulose and kerogen from oil shale that on thermal depolymerization become a source for aromatic and kerosene based oil fractions respectively.

34 Claims, 2 Drawing Sheets

Flow Chart of the Tar Sands Process:

Flow Chart of the Terrestial Plant and Shale Processes:

SEPARATION OF TARS, OILS AND INORGANIC CONSTITUENTS FROM OIL BEARING SANDS OR SHALES

SPECIFICATIONS/BACKGROUND OF THE INVENTION

This invention relates to the separation and isolation of oil sand aggregates into four components: 1) tars and pitches, 2) a kerosene fraction, 3) clays, silts (particle sizes of less than 80 $\mu$m) and 4) sand (particles sizes of greater than 80 $\mu$m).

It is known that oil sands can be separated and oil fractions isolated by one of many processes of which the ranked highest to lowest preference is the:

a) CHWE (Clark Hot Water Extraction Process) [1], b) OSLO HWE (Oslo Hot Water Extraction Process) [2], c) OSLO CWE (Oslo Cold Water Extraction Process) [2], d) AOSTRA—Takiuk Process [3], e) ZEFTE (Zero Fine Tailings Extraction Process) [4], and f) BITMIN (Counter Current Desander Process) [5].

[1] FTFC (Fine Tailings Fundamentals Consortium) "Vol 4–29. Laboratory Experiments on the Clark Process" In: *Advances in Oil Sands Tailings Research*, Alberta Department of Energy, Oil Sands and Research Division, Publisher.

[2] FTFC (Fine Tailings Fundamentals Consortium) "Vol 4–9. OSLO Hot and Cold Water Extraction Processes" In: *Advances in Oil Sands Tailings Research*, Alberta Department of Energy, Oil Sands and Research Division, Publisher.

[3] FTFC (Fine Tailings Fundamentals Consortium) "Vol 4–6. AOSTRA—Takiuk Process" In: *Advances in Oil Sands Tailings Research*, Alberta Department of Energy, Oil Sands and Research Division, Publisher.

[4] FTFC (Fine Tailings Fundamentals Consortium) "Vol 4–8. Zero Fine Tailings Extraction (ZEFTE)" In: *Advances in Oil Sands Tailings Research*, Alberta Department of Energy, Oil Sands and Research Division, Publisher.

[5] FTFC (Fine Tailings Fundamentals Consortium) "Vol 4–8. BITMIN" In: *Advances in Oil Sands Tailings Research*, Alberta Department of Energy, Oil Sands and Research Division, Publisher.

This invention relates to the separation and isolation of resins and kerogens.

It is also known that resinous and wax like products can be separated from their host habitat by means of prolonged continuous Soxhlet extraction. The efficacy of extraction has been substantially increased by expanding the range of solvents used in analytical extraction tools such as Solid Phase Extraction (SPE) [6], Supercritical Fluid Extraction (SFE) [7], Pressure Fluid Extraction (PFE) [8], Accelerated Solvent Extraction (ASE) and Microwave—Accelerated Solvent Extraction (M-ASE) [9].

[6] Zief, M., Kieser, R., *Solid Phase Extraction for Sample Preparation*. Mallinckrodt Baker Inc. 1997.

[7] R. E. Majors LC/GC 17(6s) 8–13 (1999)

[8] Richter, B. E. LC/GC 17(6s) 22–28 (1999)

[9] Le Blanc, G., LC/GC 17(6s) 32–36 (1999)

To date, applications have involved micro analytical extraction of organic analytes from solid phases. One commercial application (known as the ALCELL PROCESS) involves the extraction of lignin from wood. A solvent mixture of methanol, ethanol and water at a pressure of 35 atmospheres is used to extract lignin from wood fiber[10].

[10] Lora, J. H. et al. U.S. Pat. No. 5,865,948

This invention, using thermal heating (preferably microwave), applies the micro analytical benefits of Accelerated Solvent Extraction to commercial applications. It extends the efficacy of the process of reduced extraction time, reduced solvent consumption and increased extraction efficiencies by introducing a temperature controllable biphasic solvent system i.e. a system that is the result of a mixture of an organic solvent and water which exhibits a Lower Critical Solution Temperature (LCST).

Some of the Inherent Problems Associated with Some or all of the Above Procceses (a–f) are:

Energy Usage

The processes require large net input of thermal and/or mechanical energy.[11]

[11] Strand, W. L.; Canadian Pat. 2 124 199 (1992 06 11)

Tailings and Storage Space

They also generate large quantities of tailings and require indefinite storage space. [11]

Bitumen Yields

Except for the AOSTRA-T Process, unacceptably low yields (54–92%) of bitumen are separable from the tar sands using present day technology. In fact, yields of 92–96% are considered to be high using the present art. [12]

[12] Sparks B. D., Majid A., Woods J.; Canadian Pat. 2 093 142 (1994 09 27)

In this invention yields of 99% are considered low from any and all of the ore bodies found in Alberta, Canada, the San Joaquin Valley of California and along the shores of the Orinoco River in Venezuela.

Hence, not only can more oil be squeezed out of less ore but utilization of the steps in our invention makes access to the lower grade ores economically viable.

Water Usage

Again, except for the AOSTRA-T Process in a–f above, large volumes of water are used in the extraction of bitumen. On average 0.7 to 3 MT of water are required per Metric Ton of ore (depending on the bitumen content of the ore). The lower the bitumen content the higher the volume of water required. Presently, in the case of the 12% bitumen content ore, 420,000 MT of water are required per day of full operation.[13]

[13] FTFC (Fine Tailings Fundamentals Consortium) "Vol. 2–3" In: *Advances in Oil Sands Tailings Research*, Alberta Department of Energy, Oil Sands and Research Division, Publisher.

Environmental Concerns

Because the spent water presently generated contains toxic naphthenates, oil residues, and fine tailings, storage and containment of the waste waters has become an integral part of the process. The presently projected required volume of settling ponds doubles every 400 days. This is expected to decrease to 300 days when the Aurora mine comes on stream in the year 2004 i.e. 460,000,000 $m^3$ per annum of new storage space for spent water shall be required.

It has been estimated that it will take 100–300 years for the colloidal of the fine tailings to agglomerate to a soft clay before release of the above mentioned waters shall be permitted to the environment. "Without further treatment of the existing fine tailings and without process modifications to reduce the rate of production of "new" fine tailings, by the year 2030, over one billion cubic meters of a non-consolidating fine tailings would exist at the bottom of these lakes." . . . since "Containment of the entire water system with the operating process is required as part of the operating license agreement between the Provincial Government and the two commercial plants." [14, 15]

[14]] FTFC (Fine Tailings Fundamentals Consortium) "Vol. 4–5." In: *Advances in Oil Sands Tailings Research*, Alberta Department of Energy, Oil Sands and Research Division, Publisher.

[15] Mac Kinnon, M. and Sethi, A.; A Comparison of the Physical and Chemical Properties of the Tailings Ponds at the Syncrude and Suncor Oil Sands Plants, Oil Sands_ Our Petroleum future Conference, Edmonton, Alberta, Apr. 4–7, 1993.

AOSTRA Taciuk Process [16]

An advantage of the AT Process is that no toxic tailings are generated. Extra energy costs incurred by the process are partially offset by elimination of treatment and maintenance costs of the wastewater containment ponds. Although the process is self sufficient, the expended energy and specialty equipment must be costed against the process. Our process minimizes such cost while providing the opportunity to sell the energy to the open market.

[16] FTFC (Fine Tailings Fundamentals Consortium) "Vol. 4–10." In: *Advances in Oil Sands Tailings Research*, Alberta Department of Energy, Oil Sands and Research Division, Publisher.

Solid Phase Extraction Processes

Solid Phase Pressure Extractions have, to date, been limited to micro analytical applications. The ALCELL PROCESS has shown that high pressures can have economic restrictive effects on commercial applications.

SUMMARY OF THE INVENTION

The present invention provides a process whereby trapped and bound bitumen can be removed from an inorganic agglomerate of various size particles. Upon detachment and because of the ability of the solvent to physically set up a phase mixture system which has inherent density and solubility extremes, tars can be separated from oils and sand or diatomaceous earths can be separated from clays and silts.

Such solvent mixtures have the ability to separate into biphasic mixtures simply by adjusting the temperature of the solution or by changing its inorganic salt concentration.

The separating solvent solution is an aqueous mixture of lipophilic liquids that exhibit a Lower Critical Solution Temperature.

Some liquids exhibit total solubility over a range of concentrations and temperatures but partition into biphasic systems at specific concentrations and temperatures. They possess the specific ability to raise the lipophilic and hydrophilic characteristics of a solution by simple manipulation of the process variables. In other words, simple adjustment of the salt concentration or temperature greatly expands the separation abilities of the constituent solvents.

An example is Butoxy Ethanol in water. Solutions of greater than 10% and less than 57% Butoxy Ethanol will, below approximately 40° C. remain in solution but partition into a biphasic system above 40° C.

For example, 100 ml of totally miscible Butoxy Ethanol (density 0.90 g/ml) will, at 50° C. give a biphasic system of 10 mls 57% Butoxy Ethanol in Water as a top phase (density 0.92 g/ml) and 90 mls of 10% Butoxy Ethanol in Water as a bottom phase (density 0.99 g/ml).

Such phenomena are known as Lower Critical Solution Temperatures. When the reverse phenomena is exhibited i.e. a biphasic mixture at a low temperature becomes a single phase at a higher temperature the solvents are said to have an Upper Critical Solution Temperature (UCST). Some mixtures do not exhibit an UCST at atmospheric pressure only because their boiling points are lower than their UCST's. In order to exhibit an UCST it becomes imperative that the solvent solution be held under pressure while being heated.

The present invention provides a method of separating the organic from the inorganic phase in tar sands with a recyclable liquid composition whose LCST is above 40° C comprising:

Sodium silicate . . . 0–2.5%

Sodium hydroxide . . . 0–2.5%

Alkyl or di alkyl glycol or di glycol ether and/or

Propyl glycol ether . . . Ingredient dependant

Triethyl amine and/or diethyl methyl and/or dimethyl pyridine and/or methyl pyridyl and/or methyl piperidene . . . 0–10%

Water . . . to 100%

Pressure . . . 1–3 atmospheres depending on the $T_g$ of the tars being extracted.

In preferred embodiments of the inventions the following proportions of components can be used. Sodium Hydroxide and/or Sodium Silicate 0–2.5%, preferably 0.5 to 2.5, particularly preferable 1–2%

All glycol ethers 0–100%, preferably 10 to 60 particularly 15–25%, especially 20%.

ADVANTAGE OF OUR PROCESS OVER THE PAST ART

Figure 1:
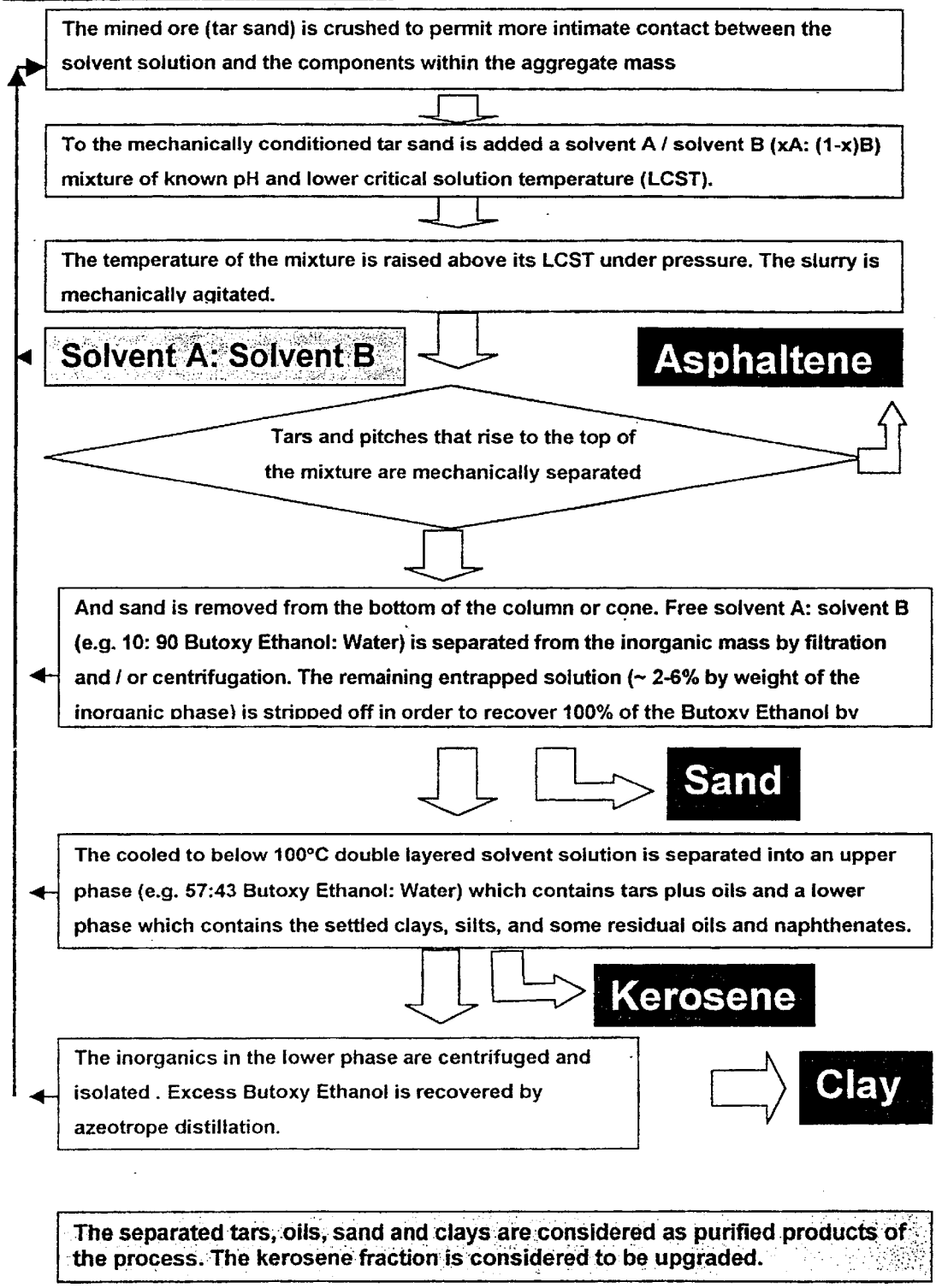
FIG. 1 is a flow chart of the tar sands process.
Figure 2:
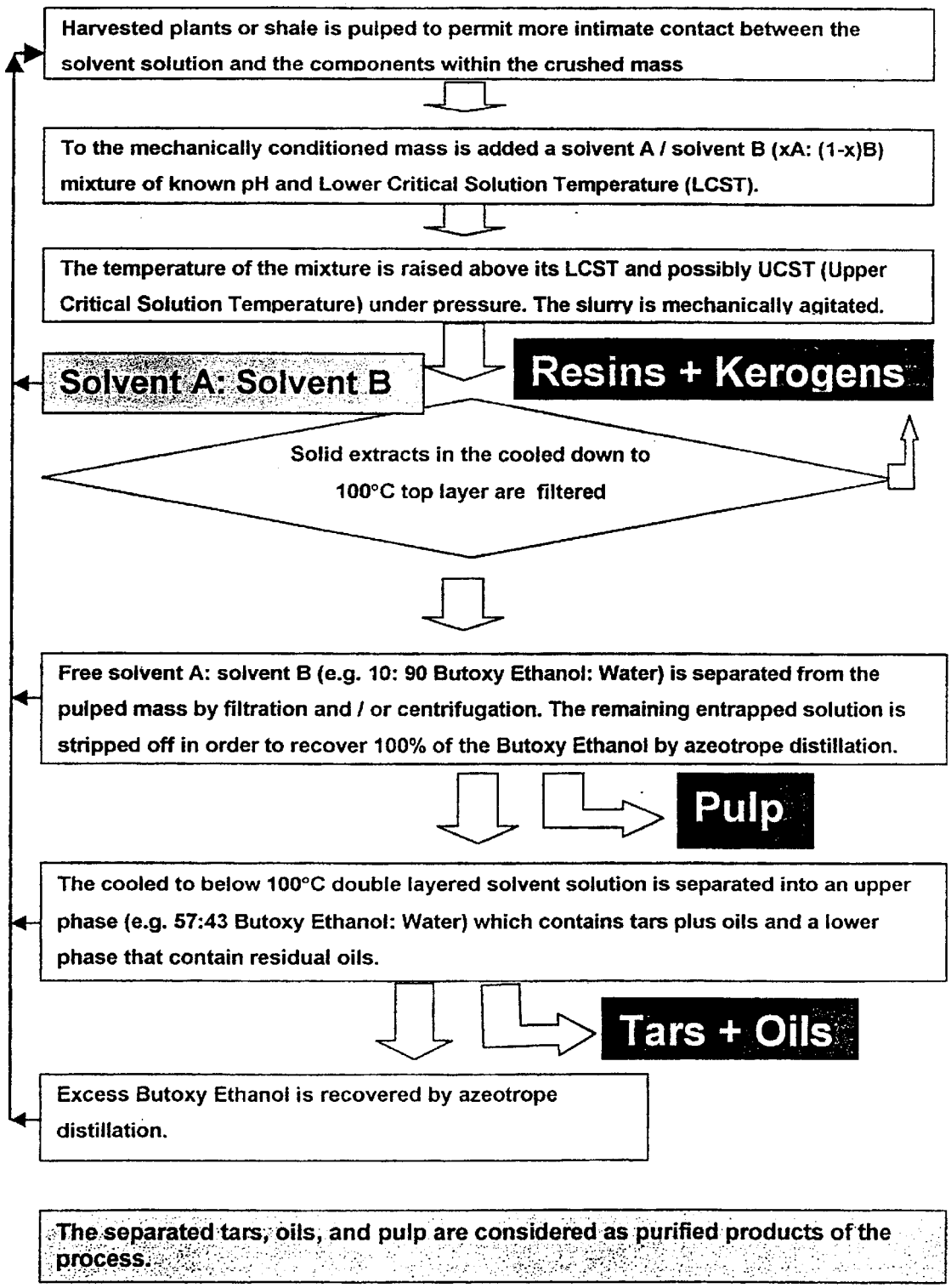
FIG. 2 is a flow chart of the terrestial plant and shale processes.

Some obvious advantages of the process are:

| | |
|---|---|
| 1) Simpiicity of the equipment and the process | Reduction in capital costs and maintenance fees. |
| 2) Raising the recovery rates of the hydrocarbon fraction well above 92% | Between 15 and 30,000 extra barrels per day over the Clark Process. |
| 3) Making the raw material source usage of the low grade Alberta ore (6–10% Bitumen content) economically viable | Some where between 90 and 120 B$US. |
| 4) Facile separation of the solid hydrocarbons from their liquid counterparts | Short cycle time and therefore reduced equipment size requirements. |
| 1) Making the raw material source usage of the tar sands from California and Venezuela economically viable | Capability to extract oil from n0n-connated tar sands |
| 6) Concentration of the liquid hydrocarbon fraction by partitioning it between the two phases of the solvent mixture at temperatures just above the LCST | Lowering the process temperature to just above 40° C. to remove oils and above 100° C. to remove heavy tars. |
| 7) Generate two separate hydrocarbon streams at the mine site (Asphaltenes and liquid hydrocarbons) | Eliminate transportation of the inorganic phases. |
| 8) Generate a solvent system which has a Freezing point of −10° C. | This is more of a pour point than a freezing point. |

-continued

| | |
|---|---|
| 9) Work with non-flammable solvents i.e. flash points above 100° C. | Insurance premiums should be low. |
| 10) Reduce energy usage | Process ores just above 40° C. |
| 11) Eliminate the need for waste water Containment ponds | No toxic waste and no fine tailings. |
| 12) Eliminate the projected volumes of toxic fine tails | Holding ponds not needed. |
| 13) Eliminate the need for Tailings Oil Recovery | No wastewater. |
| 14) Recycle the solvent system in a closed cycle | Recovery of the naphthenates and thio compounds. |
| 15) Segregation of the mineral clays from the sand for further processing | Recovery of >99% pure silicon dioxide |
| 16) Provide the opportunity to recover precious metals from the inorganic isolants. | |
| 17) Extension of the process to cleaning up man made spills | |
| 18) Reduction of the extraction process to 3–4 minutes using a solvent system under pressure | Decreasing the cycle time and reducing the extraction process to in (pipe) line processing. |
| 19) Reduction of the solvent volumes to half the weight of the sand being processed. | |

EXPERIMENTAL EXAMPLE

1) To a 6–12% by weight sample of tar sand add an equivalent weight of greater than 10% by volume Butoxy Ethanol in Water. The solvent mixture may contain up to 0.75% of sodium hydroxide and meta sodium silicate respectively.
2) The mixture is stirred and a stream of air introduced while being heated above 40° C.
3) Heating the mixture above 40° C. causes the liquid to separate into two layers or phases. The upper layer and lower layers are 57:43 and 10:90 solutions of Butoxy Ethanol: Water respectively.
4) Tars and pitches (Asphaltenes) whose densities are less than 0.99 g/cc rise to the upper layer. Those which are greater than 0.92 and less than 0.99 g/cc rise to the interface between the two layers.
5) The asphaltenes can now be isolated by filtering/centrifuging, those which are suspended in the liquid, and by skimming those surfaces on which they have been deposited.
6) The asphaltenes are further processed at the refinery level.
7) The sand found at the bottom of the column or cone is further washed with an equivalent weight of fresh BE: Water at a temperature of 120 to 130° C. to ensure all tar has been removed. Bitumen free sand is passed through a centrifugal thickener as is used in the paper industry. The semi dry, silt free sand is flashed in order to azeotropicly recover all butoxy ethanol. The purified sand (greater than 99% $SiO_2$) can be used as an abrasive or by the glass industry. Coarser sands found in the San Joaquin samples can be sieved for construction industry use.
8) The clay collects on top of the sand. Agitation causes the fine particles to separate from the larger sand particles.
9) Within the scope of our experiment we used an aspirator attached to a pasteur pipette to collect the clay. Heating the clay in the presence of the 120–130° C. solvent ensure bitumen free clay is formed. The clay is azeotropicaly dried.
10) Separation of the clay and bitumen is attained by centrifugation.
11) Depending on the source of the ore, the cleaned clays (mainly kaolinite and illite) may have commercial applications or precious metal extraction possibilities.
12) The kerosene fraction is found dissolved in the top layer. It is recovered by fractional distillation.
13) All recovered solvents and washings are recycled. They can be used "as is" in a primary extraction step or after purification by distillation.
14) Bitumen yields of greater than 99% are attainable.

The embodiment of the invention in which an exclusive property or privilege is claimed and defined as follows:

1. A method of separating and isolating a plurality of components of a mixture selecting consisting of oil bearings sands and shales from a substrate, comprising the steps of:

a) breaking down the mixture;

b) adding at least one solvent to the mixture wherein said solvent comprises water and butoxy ethanol and said solvent exhibits a lower critical solution temperature;

c) raising a temperature of the mixture to greater than 100° C.;

d) separating free solvent from the mixture; and e) separating the solvent into an upper phase and a lower phase.

2. The method of claim 1, wherein step (a) is accomplished by crushing the substrate.

3. The method of claim 1, wherein step (a) is accomplished by pulping the substrate.

4. The method of claim 1, wherein, in step (c), the temperature is raised to between 120 and 130° C.

5. The method of claim 1, wherein, during step (c), the mixture is under pressure.

6. The method of claim 1, further comprising the step of agitating the mixture between steps (c) and (d).

7. The method of claim 1, further comprising the step of separating at least one solid extract that rises to a top of the mixture between steps (c) and (d).

8. The method of claim 7, wherein the solid extract is selected from the group consisting of:

a) resins;

b) kerogens;

c) tars;

d) pitches; and e) asphaltene.

9. The method of claim 1, further comprising the step of removing sand from a bottom of the mixture between steps (c) and (d).

10. The method of claim 1, wherein step (d) is performed by a process selected from the group consisting of filtration and centrifugation.

11. The method of claim 1, wherein the upper phase in step (f) comprises 57% butoxy ethanol and 43% water.

12. The method of claim 11, wherein the upper phase further comprises a plurality of materials selected from the group consisting of tars and oils.

13. The method of claim 1, wherein the lower phase in step (f) comprises a plurality of materials selected from the group consisting of:

a) residual oils;

b) settled sand;

c) silt; and d) clay.

14. The method of claim 1, further comprising, after step (f) the step of separating inorganic material in the lower phase from the mixture.

15. The method of claim 1, further comprising, after step (f), the step of recovering excess solvent.

16. The method of claim 1, wherein the solvent includes at least one basic salt.

17. The method of claim 16, wherein the basic salt is selected from the group consisting of sodium hydroxide and sodium meta silicate.

18. The method of claim 1, further comprising the step of controlling an ionic strength by an addition of salts.

19. The method of claim 1, further comprising the step of controlling a freezing point by adjusting a ratio between the solvents in the mixture.

20. The method of claim 1, further comprising the step of controlling a lower critical solution temperature (LCST) by adjusting a ratio between the constituents in the mixture.

21. The method of claim 1, further comprising, during step (b), the step of injecting the solvent in a counter current manner and at a temperature less than the lower critical solution temperature such that the solvent is heated as it moves through the mixture.

22. The method of claim 21, wherein a lower temperature solvent starts to remove the oils from the mixture and a higher temperature solvent phase concentrates the oils.

23. The method of claim 21, rein a higher temperature solvent removes viscous tars from a surface of the mixture.

24. The method of claim 1, wherein a counter current introduces air into the mixture such that a lower density hydrocarbon rises towards a top of the mixture.

25. The method of claim 1, wherein a counter current introduces air into the mixture such that a plurality of smaller sized particles rise towards a top of the mixture.

26. The method of claim 1, wherein a counter current introduces air into the mixture such that the upper phase liquid rise towards a top of the mixture.

27. The method of claim 1, further comprising the step of distributing a solid ore into a plurality of sized particle layers such that the sized particle layers can be shunted for further refining processes.

28. The method of claim 27, wherein the plurality of sized particle layers are selected from the group consisting of clay, silt and sand.

29. The method of claim 1, wherein, in step (f), the upper phase comprises a plurality of oils.

30. The method of claim 1, wherein, in step (f), the lower phase comprises a plurality of materials selected from the group consisting of extracted inorganic salts, naphthenates and thio compounds.

31. The method of claim 1, further comprising, after step (e), the step of regenerating one of the phases by azeotropic distillation.

32. The method of claim 1, further comprising the step of separating the solvent and a plurality of solids in the lower phase using a Double Nip Thickener (DNT).

33. The method of claim 1, wherein the solvent comprises at least one non-flammable solvent.

34. The method of claim 1, further comprising the step of hydrostatically transporting a plurality of solid ores at less than 0° C. temperatures.

* * * * *